US005165678A

United States Patent [19]

Koseki et al.

[11] Patent Number: 5,165,678

[45] Date of Patent: Nov. 24, 1992

[54] PAPER FEED DEVICE

[75] Inventors: Masaaki Koseki; Makoto Kurosawa, both of Ibaraki, Japan

[73] Assignee: Hitachi Koki Co., Ltd., Tokyo, Japan

[21] Appl. No.: 700,974

[22] Filed: May 16, 1991

[30] Foreign Application Priority Data

May 25, 1990 [JP] Japan ..... 2-135756

[51] Int. Cl.[5] ..... B65H 1/26

[52] U.S. Cl. ..... 271/157; 271/217

[58] Field of Search ..... 271/3.1, 217, 157-159

[56] References Cited

U.S. PATENT DOCUMENTS 4,350,333 9/1982 Landa ..... 271/217
4,390,175 6/1983 Takahashi ..... 271/157
4,801,135 1/1989 Povio ..... 271/157 X
4,852,869 8/1989 Watanabe ..... 271/157 X
4,927,131 5/1990 Hashimoto ..... 271/217 X

*Primary Examiner*—Richard A. Schacher
*Attorney, Agent, or Firm*—Sughrue, Mion, Zinn Macpeak & Seas

[57] ABSTRACT

A paper feed device for holding a stack of printing paper sheets, has a paper holder box, a paper support bed on which the paper sheets are adapted to be placed and an elevator mechanism for moving the paper support bed upward and downward, a sensor detects the height of the paper sheets, whereby at the time of supply of the paper sheets, the paper support bed is moved downward so that the level of the paper sheets can be at a predetermined height relative to an upper end of the paper holder box.

3 Claims, 2 Drawing Sheets

PAPER FEED DEVICE

BACKGROUND OF THE INVENTION

1. Field of the Invention

This invention relates to a device for feeding printing paper in a printer or the like.

2. Prior Art

In a printer employing an electrophotographic device or the like, the printing speed has been getting higher year after year, and in order to save labor, associated paper feed devices paper discharge devices have also been increased in capacity. However, as shown in FIG. 2, because of such a large-capacity design, a paper holder box 1 has an increased height, and at the time of an initial loading of paper sheets 2 into the paper holder box, a paper support bed 3 on which the paper sheets 2 are placed is disposed very deep in the paper holder box. One set of cut sheets used for the printing are usually very large in number (for example, 500 or 1,000), and since the bottom of the paper holder box is disposed at the deep position as described above, the loading of the paper sheets can not be done easily. And besides, the paper sheets between the adjacent sets are liable to be displaced with respect to each other, and, are liable to make a curled portion 9 at the end of the paper as indicated in FIG. 3, which may result in the jamming of the paper sheet during the paper feed. To avoid this difficulty, it has been proposed to provide a notch 7 in one side wall of the paper holder box 1. However, this arrangement has failed to achieve satisfactory effects.

SUMMARY OF THE INVENTION

An object of this invention is to overcome the above deficiencies of the prior art and to facilitate the loading of paper sheets when supplying the paper sheets.

In the present invention, attention is directed to the fact that if the height of a paper support bed 3 or the height of paper sheets 2 is close to an upper edge of a paper holder box 1 at the time of the paper sheet loading, the loading of the paper sheets can be done easily. In view of this, the height of the paper sheets at the time of supply of the paper sheets is detected by a sensor, and the height of the paper sheets is controlled to a predetermined height.

DETAILED DESCRIPTION OF THE PREFERRED EMBODIMENT

Figure 1:
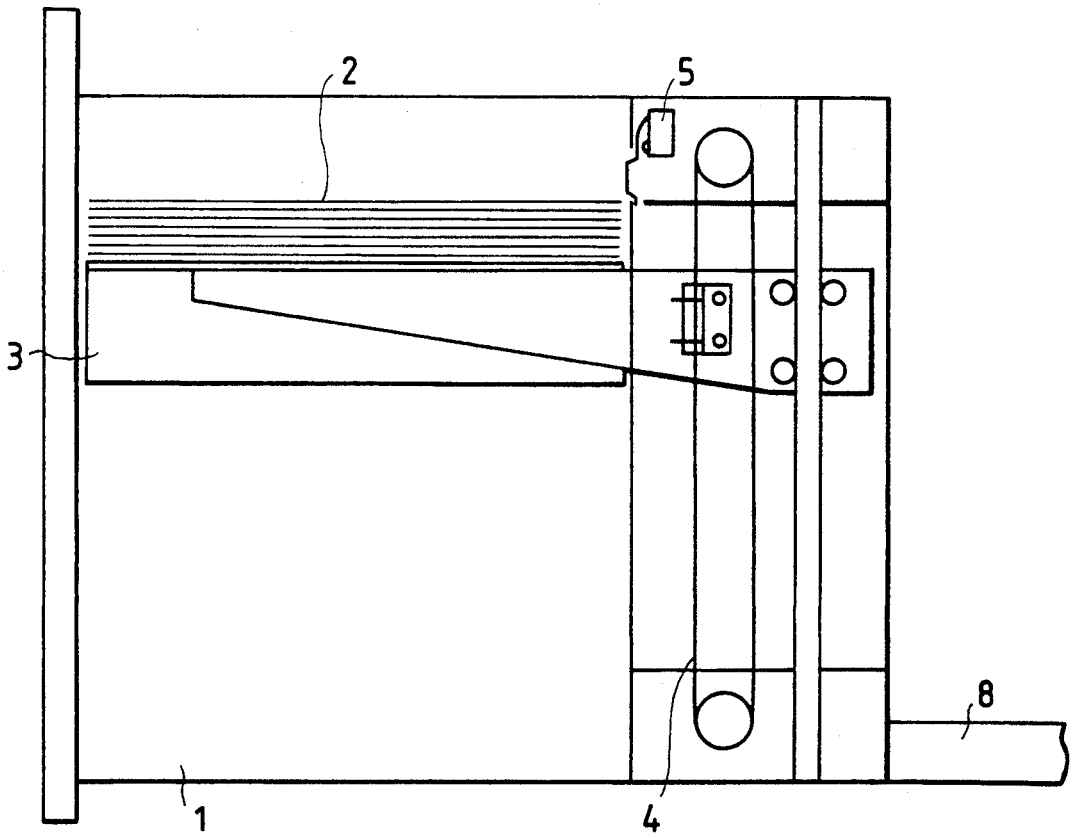
FIG. 1 is a schematic view of a preferred embodiment of a paper feed device of the present invention.
Figure 2:
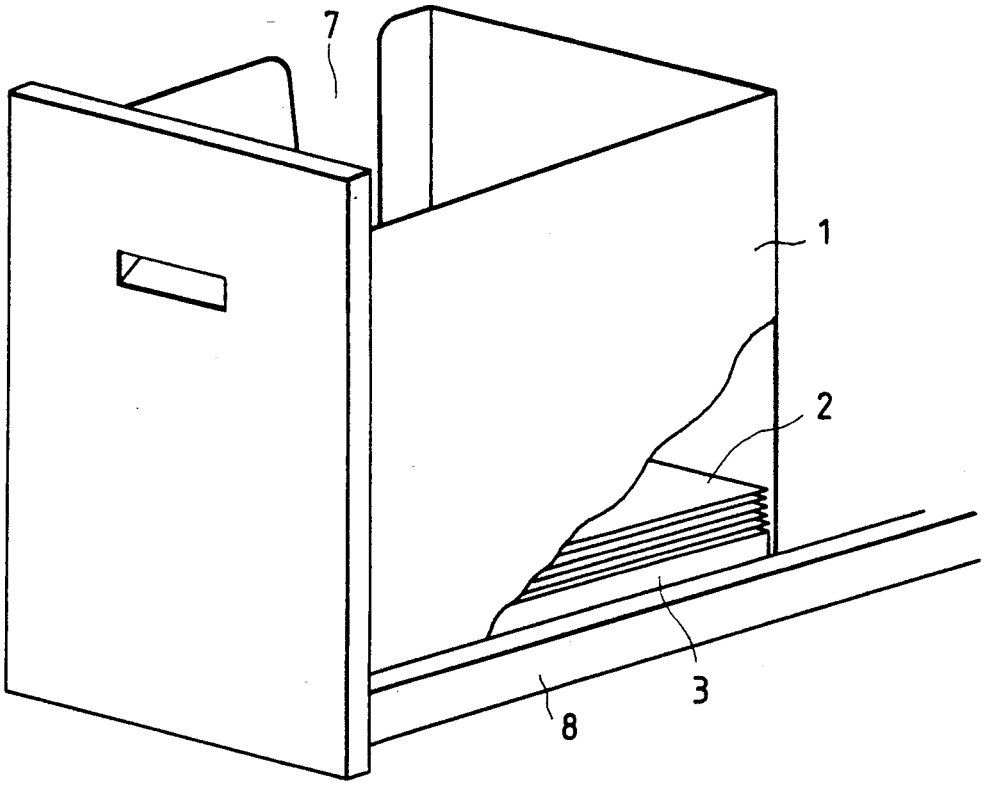
FIG. 2 is a perspective view of a conventional paper feed device.
Figure 3:
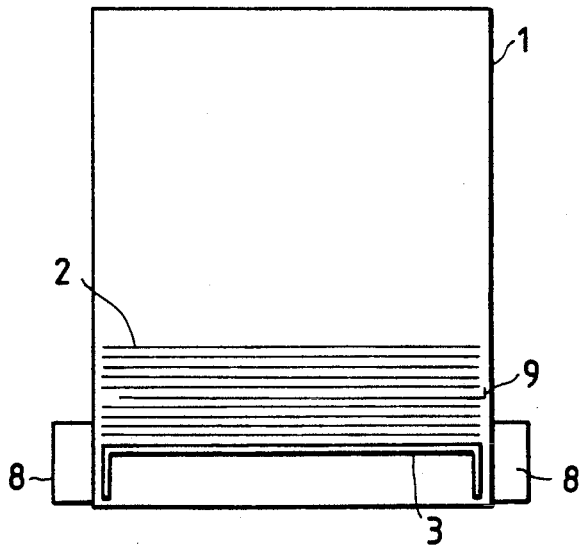
FIG. 3 is a schematic view showing one example of displacement of a paper sheet when the paper sheets are set.

A preferred embodiment of the present invention will now be described with reference to FIG. 1.

A paper support bed 3 is provided within a paper holder box 1, and is moved upward and downward by an elevator device 4. The paper supply box 1 is received in a body (not shown) when the device is in use, and is withdrawn through a slide rail 8 when paper sheets are to be supplied. A paper height sensor 5 according to the present invention is provided at the inner side of the paper holder box 1. This sensor becomes effective when the paper holder box 1 is withdrawn from the initial position for the purpose of the paper supply. Next, the movement of the paper support bed 3 at the time of the paper supply will now be described. When the paper holder box 1 is withdrawn, the paper support bed 3 descends until the paper height sensor 5 is turned off, and is stopped there. Then, when one set of paper sheets is supplied, the paper height sensor is turned on, and the paper support bed 3 descends until this sensor is again turned off upon lapse of a certain predetermined time period. This procedure is repeated until the paper holder box is fully loaded with the paper sheets. The above operation is carried out also in the case where some paper sheets remain in the paper holder box when the paper holder box is withdrawn, and the paper support bed 3 first descends until the paper height sensor 5 is turned off, and the above operation is repeated.

Although the paper height sensor is shown as a mechanical sensor in FIG. 1, the same effects can be obtained when this sensor is an optical sensor. Also, in the case where a plurality of optical sensors such as an diode array is used, the initial stop position of the paper sheets can be arbitrarily selected, and it can be adjusted to the size of one set of paper sheets.

In the present invention, the height of the paper sheets at the time of loading of the paper sheets can be controlled to a predetermined height, and the loading of the paper sheets can be done easily, and displacement and curling of the paper sheets at the time of setting of the paper sheets can be prevented, thereby avoiding jamming of the paper sheets.

What is claimed is:

1. A paper feed device for holding a stack of printing paper sheets, comprising:

a paper holder constructed so s to hold paper sheets, said paper holder means being movable between a first position corresponding to a feeding operation therefrom and a second position wherein paper sheets are loaded into said paper holder;

a paper support device on which the paper sheets are placed, said paper support device being disposed in said paper holder;

an elevator disposed in said paper holder and operatively connected to said paper support device so as to move said paper support device in upward and downward directions; and a sensor provided in said paper holder so as to detect the height of the stack of paper sheets positioned on said paper support device;

said elevator moves said paper support device downward in response to a signal from said sensor and a movement of said paper holder to said second position so that a level of the stack of paper sheets is set to a predetermined height relative to an upper portion of said paper holder means.

2. A device as claimed in claim 1, wherein said sensor is a mechanical sensor.

3. A device as claimed in claim 1, wherein said sensor comprises an optical sensor.

* * * * *